US005246146A

United States Patent [19]

Bartimes et al.

[11] Patent Number: 5,246,146

[45] Date of Patent: Sep. 21, 1993

[54] PUMP REPLACEMENT ASSEMBLY

[75] Inventors: George F. Bartimes, Chicago, Ill.; Leonard A. Blomquist, Williamsburg, Va.

[73] Assignee: Continental Plastic Containers, Inc., Norwalk, Conn.

[21] Appl. No.: 622,014

[22] Filed: Dec. 4, 1990

[51] Int. Cl.[5] ..... B67D 5/40

[52] U.S. Cl. ..... 222/382; 222/383; 222/464

[58] Field of Search ..... 222/129, 383, 211, 382, 222/372, 479, 464, 478, 481, 481.5, 542, 568; 239/329, 333

[56] References Cited

U.S. PATENT DOCUMENTS

| | | | |
|---|---|---|---|
| 4,257,539 | 3/1981 | Cary et al. | 222/383 |
| 4,527,741 | 7/1985 | Garneau | 222/383 |
| 4,728,009 | 3/1988 | Schmidt | 222/382 |
| 4,863,071 | 9/1989 | Guss et al. | 222/383 |
| 4,958,754 | 9/1990 | Dennis | 222/382 |

*Primary Examiner*—Michael S. Huppert
*Assistant Examiner*—Philippe Derakshani
*Attorney, Agent, or Firm*—Eugene F. Friedman 20 Claims, 4 Drawing Sheets

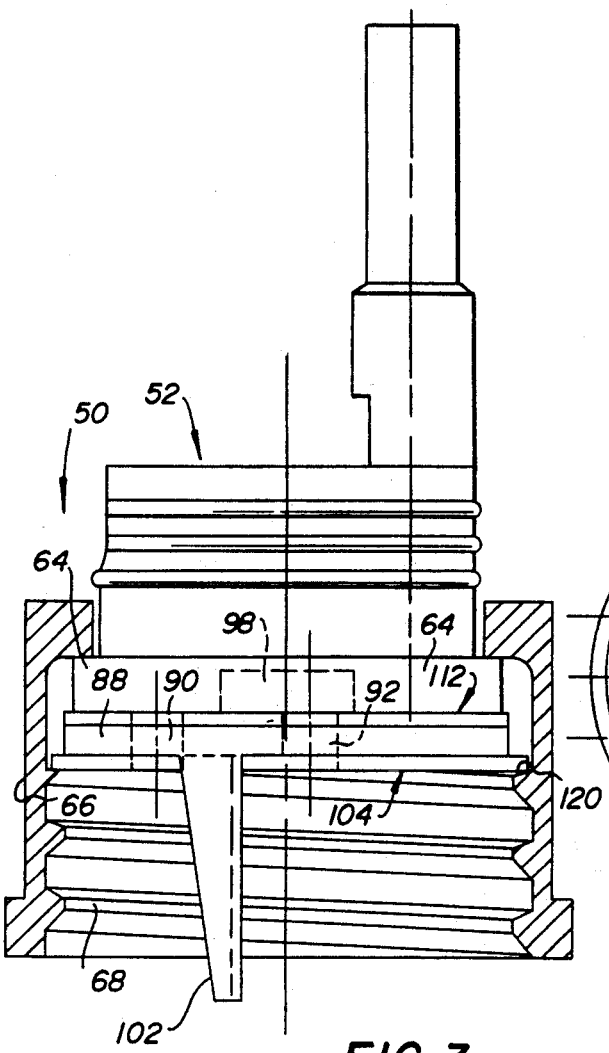
FIG. 3
FIG. 5
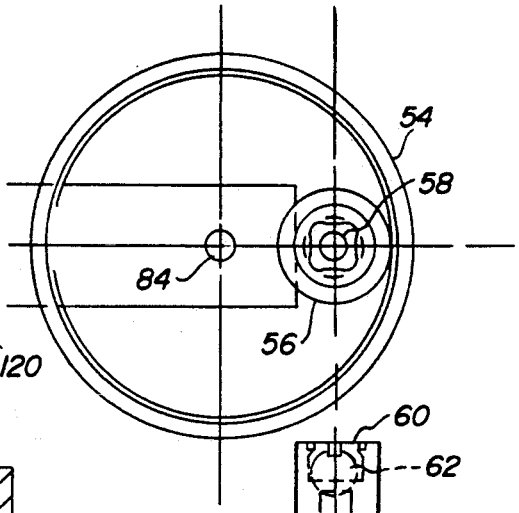
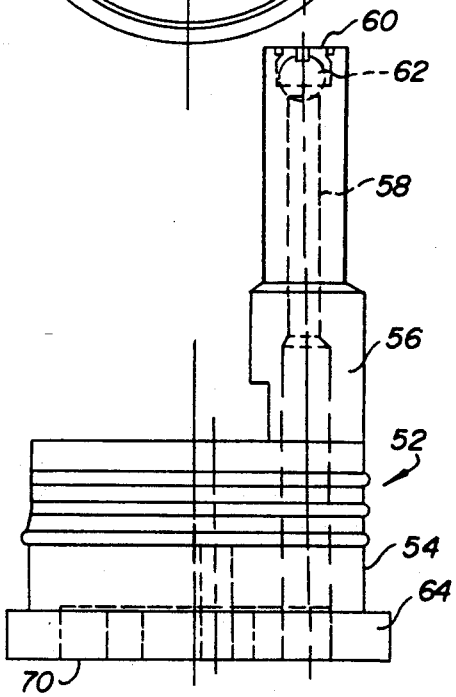
FIG. 4

FIG. 13
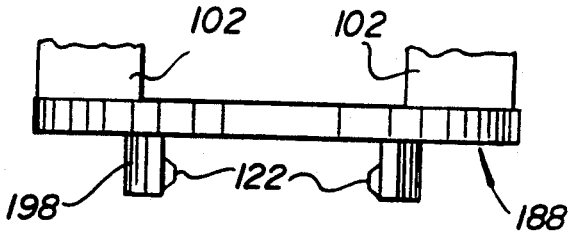
FIG. 12
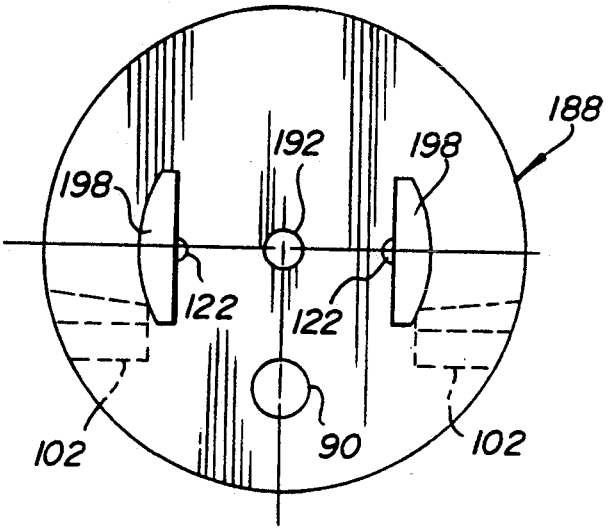
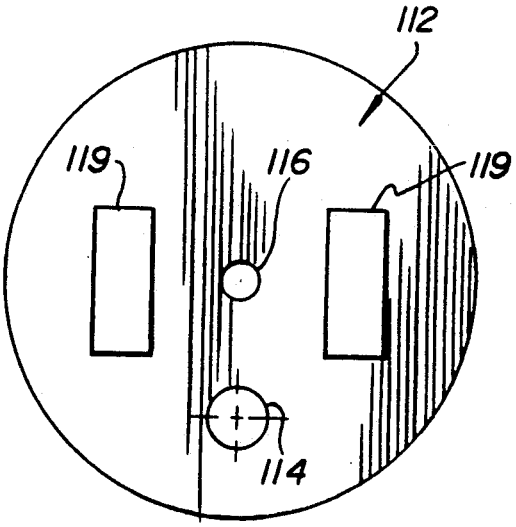
FIG. 10
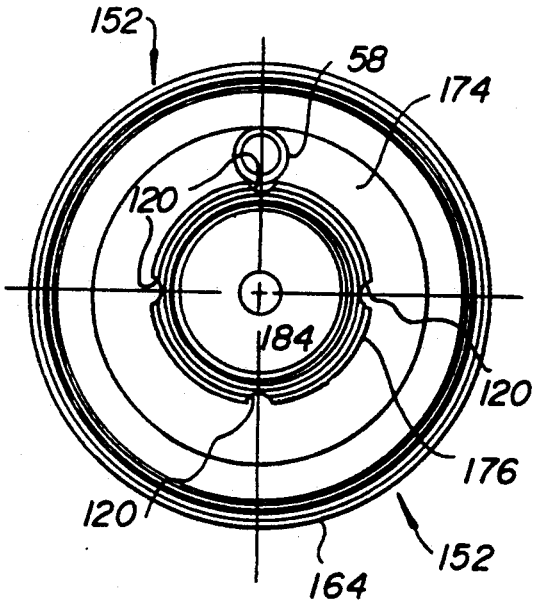
FIG. 11

PUMP REPLACEMENT ASSEMBLY

This invention in particular relates to a pump replacement assembly particularly constructed for converting an existing pump for use in conjunction with the application of household cleaners and the like to utilize a container wherein the customary pickup tube is molded as an integral part of the container.

BACKGROUND OF THE INVENTION

There has been on the market for years container and pump assemblies for products which are to be sprayed, such as household cleaners, which include a conventional container having a threaded neck finish and a pump which is threaded thereon and which has an elongated pickup tube which extends down into the container for picking up the liquid product stored within the container. These prior units have a deficiency in that the pickup tube is carried by the pump and is of a length so that it reaches the bottom of the container. As a result, when the pump is to be assembled with the container, it must be first placed in an elevated position where the lower end of the pickup tube will enter into the container mouth, after which the pump assembly must then be lowered and applied to the container. This makes assembly of the pump with the container relatively slow.

SUMMARY OF THE INVENTION

Work has been done to commercialize a blow molded plastic container having an integral pickup tube. The net result has been a neck finish on a container to which a conventional type of pump may be readily adapted utilizing a replacement assembly for the pickup portion of the pump. The replacement assembly eliminates the centrally located opening for the pickup tube and moves the same to a radially offset position while providing a vent passage which will be aligned with the mouth of the container. More particularly, the pump replacement assembly includes a combined pickup and vent unit which is to be snapped into a conventional pump housing for cooperation with the pump mechanism of the pump together with a backup disc which is constructed to interlock with the container and maintain a seal with both the container mouth and the container pickup tube. Further, in accordance with the invention, the backup disc is interlocked with the body of the replacement combined pickup and vent member so as to orient the pump with respect to the container. The connection between the body of the replacement member and the backup disc permits the pump to be oriented in several selected positions relative to the container.

With the above and other objects in view that will hereinafter appear, the nature of the invention will be more clearly understood by reference to the following detailed description, the appended claims, and the several views illustrated in the accompanying drawings.

FIG. 3 is an enlarged elevational view of the pump replacement assembly shown separate from the pump and the container and within an associated nut, which nut is shown in section.

FIG. 4 is an elevational view of the combined vent and pickup member.

FIG. 5 is a top plan view of the member of FIG. 4.

FIG. 10 is a bottom plan view of a gasket to be disposed between the backup disc and the body.

FIG. 11 is a bottom plan view of a modified form of body which permits numerous orientations of the backup disc.

FIG. 12 is a top plan view of a modified form of backup disc carrying detents which are engageable in detent pockets and the modified body.

FIG. 13 is a fragmentary elevational view of the modified backup disc of FIG. 12 showing further the details of the detents.

DESCRIPTION OF INVENTION

Figure 1:
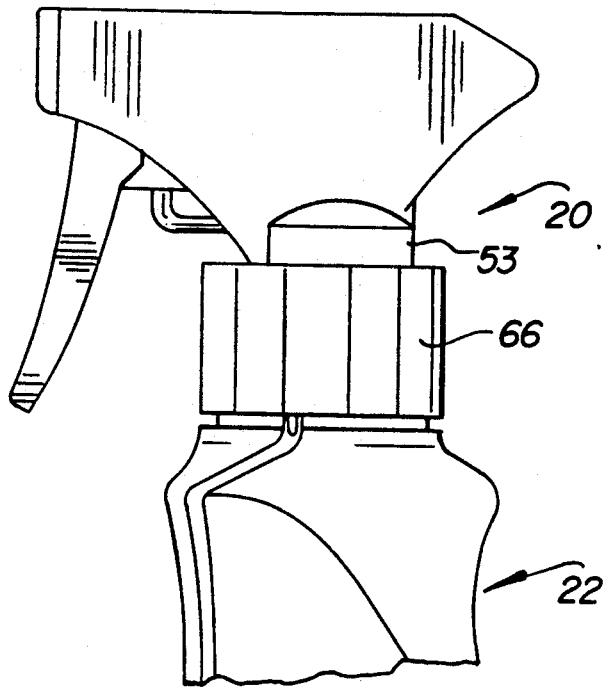
FIG. 1 is an elevational view of a container and pump assembly in accordance with this invention.

Referring now to the drawings in detail, it will be seen that there is illustrated in FIG. 1 a pump unit generally identified by the numeral 20 which has been adapted to be threadly engaged with the neck finish of a special container 22.

Figure 2:
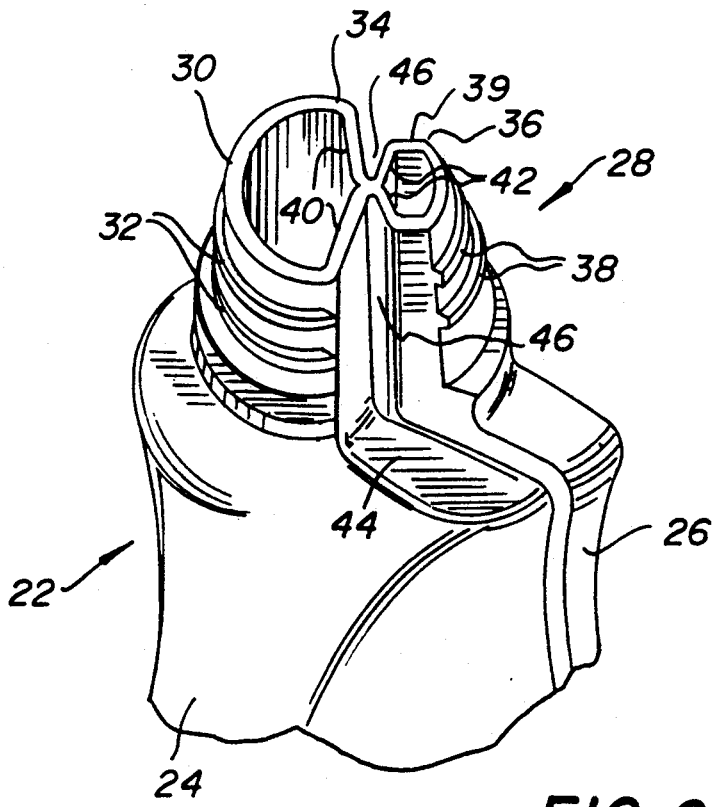
FIG. 2 is a top perspective view of an upper part of a container formed in accordance with this invention and shows the arrangement of the mouth and the top of the pickup tube of the container.

Referring now to FIG. 2, it will be seen that there is illustrated the top part only of the special container 22 which is of a blow molded plastic construction and which has a body 24 of a generally rectangular cross section and which body is provided along one end thereof with an integral pickup tube 26 that opens into the container body 24 at the bottom thereof in a manner not shown. The container 22 is provided with a specific neck finish generally identified by the numeral 28 which includes a mouth defining portion 30 having external partial threads 32 and terminating in an end finish 34. In a similar manner, the pickup tube 26 terminates at its upper end in a mouth defining portion 36 which is provided with interrupted threads 38 which are continuations of the threads 32. The mouth defining portion 36 terminates in an end sealing surface 39 which is coplanar with the end sealing surface 34.

The mouth defining portions 30, 36 of the container neck finish 28 have opposed angularly disposed walls 40, 42 connected together by a joining strip 44. The walls 40, 42 define a V-shaped cross sectional vertically extending space 46 on each side of the strip 44. The V-shaped cross sectional spaces 46 serve a definite purpose in the orientation of the pump 20 relative to the container 22 as will be described hereinafter.

It is to be understood that the pump 20 is of a conventional construction except for a pump replacement assembly which is a principal feature of this invention and which is generally identified by the numeral 50. As is best shown in FIG. 3, the pump replacement assembly 50 includes a replacement combined vent and pickup member generally identified by the numeral 52 which is constructed to snap into the housing 53 of the pump 20 in the same manner as an original combined vent and pickup member (not shown).

The member 52, with reference to FIG. 4, includes a body 54 which has extending upwardly therefrom an upwardly projecting pickup tube 56 defining a pickup passage 58. At the upper end of the pickup tube 56 there is a ball check valve assembly 60 including a ball 62.

At this time it is pointed out that the body 54 and a lower part of the pickup tube 56 are constructed for snap interlocking engagement within the pump housing 53. Inasmuch as this interlocking is conventional, it will not be described in detail here.

Figure 6:
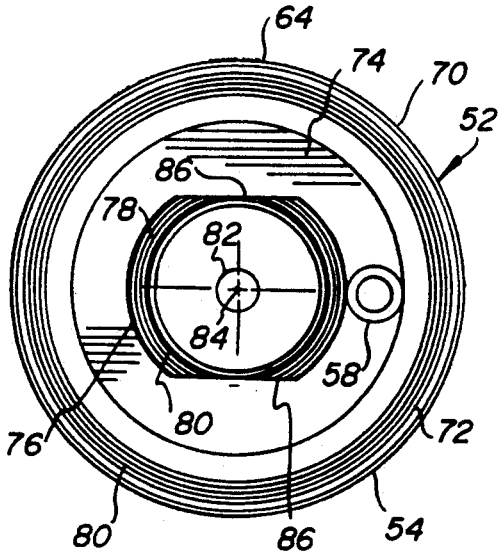
FIG. 6 is a bottom plan view of the member of FIG. 4 and shows most specifically the arrangement of a pickup passage and a vent passage opening through the bottom of a body thereof.

It is also to be noted that the body 54 terminates at its lower end in a flanged portion 64 which is circular in outline and shown in FIGS. 5 and 6. As shown in FIG. 3, the flanged portion 64 serves to retain as part of the pump 20 a nut 66. The nut 66 is provided with internal threads 68 which are engageable with the partial threads 32, 38 of the container neck finish 28 so as to fixedly secure the pump 20 on to the container 22.

For descriptive purposes, it may be said that the flanged portion 64 of the body 54 has a container opposing face 70. The face 70 is best illustrated in FIG. 6.

It will be seen that the face 70 includes an outermost annular sealing surface 72 which is defined by a generally annular recess 74. The recess 74 also defines a central part 76 having a sealing surface 78 which is coplanar with the sealing surface 72. If desired, the sealing surfaces 72, 78 may be enhanced by a plurality of fine circular grooves 80.

As is best shown in FIG. 6, the pickup passage 58 opens through the face 70 within the recess 74 in radially offset relation to an axial center 82 of the member 52. The body 52 is also provided with a through vent passage 84 which extends from the top of the body 54 as shown in FIG. 5 through the body and out through the face 70 as shown in FIG. 6. It will be seen that the vent passage 84 is centered on the center 82.

Figure 7:
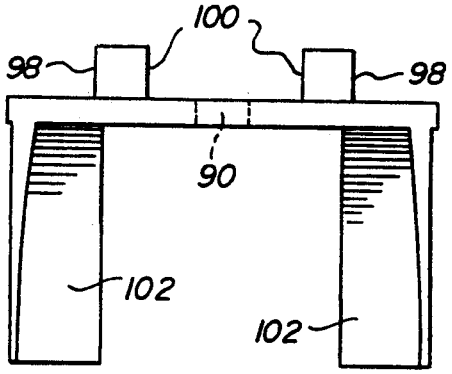
FIG. 7 is an elevational view of the backup disc and shows the projections carried thereby.

In one embodiment of the invention, as is most specifically shown in FIG. 6, the central portion 76 is provided with flat sides 86 which are arranged in diametrically remotely facing relation and which are parallel to the radial line extending through centers of the vent passage 84 and the pickup passage 58. The flat sides 86 are utilized to align a backup disc, generally identified by the numeral 88, and best illustrated in FIGS. 7 and 8 with the body 54. The backup disc 88 has formed therethrough a pickup passage 90 and a vent passage 92. The passages 90, 92 are disposed along a radial line 94 which extends through a center 96 of the disc 88. It is to be understood that the center 96 aligns with the center 82 of the body 54. It is to be noted, that the vent passage 92 in the backup disc 88 is centered on the center 96.

In order to effect alignment of the backup disc 88 selectively with the body 54, there is projecting upwardly from the backup disc 88 a pair of projections or lugs 98 which are generally rectangular in outline and have flat opposed sides 100 which will engage the surfaces 86 so as to prevent relative rotation between the backup disc 88 and the body 54.

It will be apparent that the backup disc 88 has two possible positions with respect to the body 54. The vent passages 84, 92 will be aligned in both positions and the pickup passage 90 will either be aligned with the pickup passage 58 or in communication with the pickup passage 58 by way of the annular recess 74.

Figure 8:
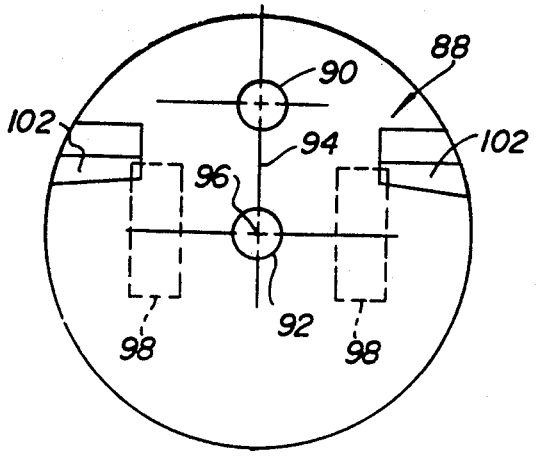
FIG. 8 is a bottom plan view of the backup disc.

The backup disc 88 is also provided with downwardly extending projections or legs 102 which are of a tapered cross section as is best shown in FIG. 8. The legs 102 are specifically positioned to fit within the V-shaped spaces 46 of the container 22 so as to align the backup disc 88 with the container neck finish 28 and thus, in turn, align the pump 20 with respect to the container 22.

Figure 9:
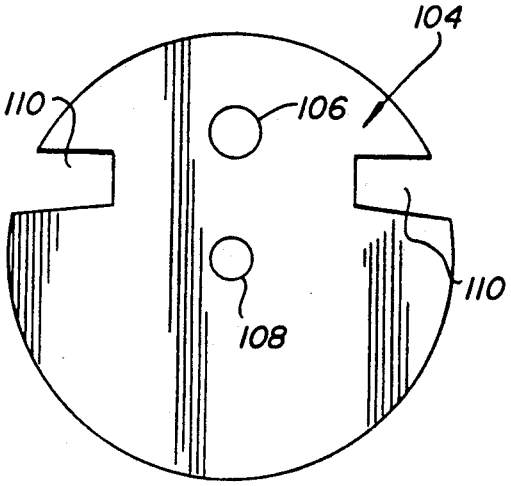
FIG. 9 is a bottom plan view of a gasket which engages the container end of the backup disc.

In order that a good seal may be effected between the underside of the backup disc 88 and the top sealing surfaces 34, 39 of the container neck finish 28, there is provided a thin gasket generally identified by the numeral 104 and illustrated in FIG. 9. The gasket 104 is of a slightly larger circular outline than the disc 88 and is provided with openings 106, 108 which align with the passages 90, 92. Further, the gasket 104 is provided with suitable notches 110 to receive the legs 102.

A second gasket, generally identified by the numeral 112, is provided for sealing the backup disc 88 relative to the face 70 of the flange portion 64 of the body 54. The gasket 112 is provided with openings 114, 116 which align with the passages 90, 92 and cutouts 119 for receiving the lugs 98. It is to be understood that the cutouts 119 are dimensioned to tightly fit on the lugs 98.

Returning once again to FIG. 3, it will be seen that the uppermost one of the threads 68 defines an undercut 120 which serves to underlie the outer periphery of the gasket 104 and thus retain the gaskets 104, 112 and the backup disc 88 within the nut 66.

The backup disc 88 will be oriented with respect to the body 54 for the contents of the container 22 to be dispensed. The vent passages 84 and 92 will be aligned for freedom of air flow into the container 22 as the liquid contained therein is dispensed by being pumped thereout of.

DESCRIPTION OF MODIFIED FORM OF INVENTION

Reference is now made to FIGS. 11–13 wherein there is illustrated a slightly modified form of the invention. Most particularly, there is provided a replacement member 152 having a modified form of flanged portion 164. The flanged portion 164 is provided with an annular recess 174 which corresponds to the recess 74. The annular recess 174 defines a central part 176 which corresponds generally to the part 76.

While the pickup passage 58 remains in the same position, it will be seen that the vent passage 184 is now centrally located. Further, it will be seen that in lieu of the central portion 176 having diametrically opposite flat sides, it is provided with a plurality of detent pockets 120. In the illustrated embodiment of the invention, the detent pockets 120 are four in number and are evenly circumferentially spaced. The number of detent pockets 120 may vary.

Referring now to FIGS. 12 and 13, it will be seen that to be utilized in association with the replacement member 152 there is provided a modified form of backup disc generally identified by the numeral 188. The backup disc 188 differs from the backup disc 88 in that the vent opening therethrough is centrally located and is identified by the numeral 192. Further, the lugs are of a slightly modified configuration and identified by the numeral 198. Finally, each lug carries on an opposed face thereof a small detent 122. The detents 122 are of a configuration and size to fit in the detent pockets 120.

As is best shown in FIG. 13, the lower portions of the detents 122 are tapered to facilitate the assembling of the backup disc 188 with the replacement member 152.

It is to be understood that the lugs 198 are slightly resilient or bendable relative to the remainder of the backup disc 188. Thus with the pump 20 assembled with the container 22, it is merely necessary to loosen the nut 66, after which the pump 20 including the member 152 may be rotated relative to the container 22 and the backup disc 188. Thus the pump 20 may be placed in as many selected positions relative to the container 22 as there are detent pockets. Inasmuch as there are pairs of detents 122, it will be apparent that the detent pockets 120 should also be provided in pairs.

Although only two preferred embodiments of the pump replacement assembly have been specifically illustrated and described herein, it is to be understood that minor variations may be made in the pump replacement assemblies without departing from the spirit and scope of the invention as defined by the appended claims.

We claim:

1. A pump replacement assembly particularly adapting a pump of the type having a projecting pickup tube for use with a container having an integral pickup tube, said replacement assembly comprising a combined pickup and vent member, said combined member including a body for insertion in a pump housing, said body having a pump end and a container end, a first vent passage extending generally axially through said body, a combined pickup tube and check valve unit projecting from said pump end of said body, said body having a first pickup passage extending through said body and in communication with said combined pickup tube and check valve unit, said first vent and pickup passages opening through said body container end in spaced generally radially offset relation, a backup disc sealed relative to said body and having a second vent passage and a second pickup passage in selected communication with respective ones of said first vent and pickup passages and being located for alignment with a container mouth and a container pickup tube.

2. A pump replacement assembly according to claim 1 together with projecting means on a container side of said backup disc for fixedly orienting said backup disc relative to a container.

3. A pump relacement assembly according to claim 1 together with interlocking means on said backup disc and said body for maintaining a fixed rotational relationship between said body and said backup disc.

4. A pump replacement assembly according to claim 2 together with interlocking means on said backup disc and said body for maintaining a fixed rotational relationship between said body and said backup disc.

5. A pump replacement assembly according to claim 2 wherein said projecting means are in the form of tapered flat pins.

6. A pump replacement assembly according to claim 1 wherein said, body container end has an inner sealing surface surrounding said first vent passage and a circumferential outer sealing surface.

7. A pump replacement assembly according to claim 1 wherein said body container end has an inner sealing surface surrounding said first vent passage and a circumferential outer sealing surface, said sealing surfaces being in the form of annular grooves.

8. A pump replacement assembly according to claim 3 wherein said interlocking means maintain said second passages in communication with said first passages.

9. A pump replacement assembly according to claim 1 wherein said body carries a nut for attaching said assembly to a container threaded neck finish, and said nut has internal threads including an axially innermost thread defining a shoulder for retaining said backup disc in cooperative relation to said body.

10. A pump replacement assembly according to claim 2 together with a container having a neck finish including a filling mouth and a pickup tube mouth separated by spaces defined by walls of said mouths, and said projecting means being in the form of elongated projections positioned within said spaces.

11. A container for use with a spray pump, said container including an integral pickup tube, said container having a neck finish including a filling mouth and a pickup tube mouth separated by spaces defined by walls of said mouths, said spaces forming means for receiving pump orienting means.

12. A container according to claim 11 wherein said walls are arranged in diverging relation with said spaces being tapered.

13. A pump replacement assembly particularly adapting a pump of the type having a projecting pickup tube for use with a container having an integral pickup tube, said replacement assembly comprising a combined pickup and vent member, said combined member including a body for insertion in a pump housing, said body having a pump end and a container end, a first vent passage extending generally axially through said body, a combined pickup tube and check valve unit projecting from said pump end of said body, said body having a first pickup passage extending through said body and in communication with said combined pickup tube and check valve unit, said first vent and pickup passages opening through said body container end in spaced generally radially offset relation, a backup disc sealed relative to said body and having a second vent passage and a second pickup passage in selected communication with respective ones of said first vent and pickup passages and being located for alignment with a container mouth and a container pickup tube, and interlocking means on said backup disc and said body for maintaining a fixed rotational relationship between said body and said backup disc, said interlocking means including said body container end having a recess therein, and said backup disc having a projection seated in said recess.

14. A pump replacement assembly according to claim 13 wherein said recess is a generally annular recess defining a central projection through which said first vent passage opens.

15. A pump relacement assembly according to claim 13 wherein said recess is a generally annular recess defining a central projection through which said first vent passage opens, and said first pickup passage opening into said recess.

16. A pump relacement assembly according to claim 14 wherein said central projection has an orienting surface facing into said annular recess and engaging said backup disc projection.

17. A pump replacement assembly according to claim 14 wherein said central projection has two diametrically opposite remotely facing surfaces facing into said annular recess and said backup disc has two of said projections each having a flat surface engaging one of said diametrically opposite remotely facing surfaces.

18. A pump replacement assembly according to claim 17 wherein said two diametrically opposite remotely facing surfaces and said flat surfaces are centrally located whereby said backup disc has two diametrically opposite selected positions relative to said body.

19. A pump replacement assembly particularly adapting a pump of the type having a projecting pickup tube for use with a container having an integral pickup tube, said replacement assembly comprising a combined pickup and vent member, said combined member including a body for insertion in a pump housing, said body having a pump end and a container end, a first vent passage extending generally axially through said body, a combined pickup tube and check valve unit projecting from said pump end of said body, said body having a first pickup passage extending through said body and in communication with said combined pickup tube and check valve unit, said first vent and pickup passages opening through said body container end in spaced generally radially offset relation, a backup disc sealed relative to said body and having a second vent passage and a second pickup passage in selected communication with respective ones of said first vent and pickup passages and being located for alignment with a container mouth and a container pickup tube, and interlocking means on said backup disc and said body for maintaining a fixed rotational relationship between said body and said backup disc, said interlocking means including said body container end having a recess therein, and said backup disc having a projection seated in said recess, said recess being generally annular and defining a central projection through which said first vent passage opens, said central projection having a plurality of circumferentially spaced orienting surfaces facing into said annular recess, and said backup disc projection selectively engaging one of said orienting surfaces to selectively rotationally orient an associated pump with respect to a container.

20. A pump replacement assembly particularly adapting a pump of the type having a projecting pickup tube for use with a container having an integral pickup tube, said replacement assembly comprising a combined pickup and vent member, said combined member including a body for insertion in a pump housing, said body having a pump end and a container end, a first vent passage extending generally axially through said body, a combined pickup tube and check valve unit projecting from said pump end of said body, said body having a first pickup passage extending through said body and in communication with said combined pickup tube and check valve unit, said first vent and pickup passages opening through said body container end in spaced generally radially offset relation, a backup disc sealed relative to said body and having a second vent passage and a second pickup passage in selected communication with respective ones of said first vent and pickup passages and being located for alignment with a container mouth and a container pickup tube, and a first gasket disposed between said body and said backup disc, and a second gasket carried by said backup disc for forming a seal with a container.

* * * * *